United States Patent [19]

Munoz

[11] Patent Number: 4,836,455

[45] Date of Patent: Jun. 6, 1989

[54] FLUID-JET-CUTTING NOZZLE ASSEMBLY

[75] Inventor: Jose P. Munoz, Joplin, Mo.

[73] Assignee: Ingersoll-Rand Company, Woodcliff Lake, N.J.

[21] Appl. No.: 163,490

[22] Filed: Mar. 3, 1988

[51] Int. Cl.[4] ..... B05B 1/00

[52] U.S. Cl. ..... 239/590.3; 51/439

[58] Field of Search ..... 51/410, 427, 429, 439, 51/319, 320; 239/590, 590.3, 590.5, 591; 175/393, 423, 424

[56] References Cited

U.S. PATENT DOCUMENTS 2,332,407 10/1943 Spenle ..... 51/439

3,130,544 4/1964 Penza ..... 239 X/590.3

FOREIGN PATENT DOCUMENTS 164867 12/1949 Fed. Rep. of Germany .

*Primary Examiner*—Andres Kashnikow

*Assistant Examiner*—Kevin P. Weldon

*Attorney, Agent, or Firm*—B. J. Murphy

[57] ABSTRACT

The Assembly comprises a centrally-bored nozzle, a centrally-bored nozzle body, and a centrally-bored jet orifice element, the three being in substantially collinear alignment along a longitudinal axis. The nozzle body has a spherical-shaped socket in which is received a spherical-shaped body portion of the element. Further, the element has a straight shank portion, extending from the body portion, which projects into a void in the nozzle body subsisting between the element and the nozzle. Adjustment screws, in penetration of the nozzle body, are arrayed about the shank portion for manipulation to adjust the attitude of the shank portion relative to the longitudinal axis.

5 Claims, 2 Drawing Sheets

FLUID-JET-CUTTING NOZZLE ASSEMBLY

This invention pertains to fluid-jet-cutting apparatus, and in particular to a fluid-jet-cutting nozzle assembly such as is used in such apparatus.

The nozzle assemblies to which this invention pertains commonly comprise a nozzle body, a nozzle, and a jet orifice element, the three being centrally bored and disposed for longitudinal alignment of the bores substantially along an axis.

Due to manufacturing tolerances, and machining imprecisions, it frequently occurs that the jet orifice element nozzle bores are not in true, axial alignment. Consequently, the highly-pressured fluid jet, passing through the bore in the element, can enter the bore in the nozzle slightly off center, and migrate toward, and impinge against, the wall of the nozzle bore. As a result, and especially if the jet has abrasive particulate therein, the nozzle bore becomes distorted, and the nozzle itself is soon unusable and must be replaced.

What has been needed is a fluid-jet-cutting nozzle assembly which will accommodate for the aforesaid tolerances and imprecisions, by allowing for axial alignment adjustments.

It is an object of this invention to meet just such a need.

It is particularly an object of this invention to set forth a fluid-jet-cutting nozzle assembly, comprising a body; a nozzle; and a jet orifice element; wherein said nozzle and element each have a fluid-accommodating bore or passage formed therethrough, and centrally thereof; said body comprises means for (a) receiving said nozzle and element therein, and (b) positioning said nozzle and element therein, in a spaced-apart disposition, with said passages in substantially collinear alignment along a given axis; and means supported in said body for selectively adjusting said positioning of said element relative to said given axis.

Figure 1:
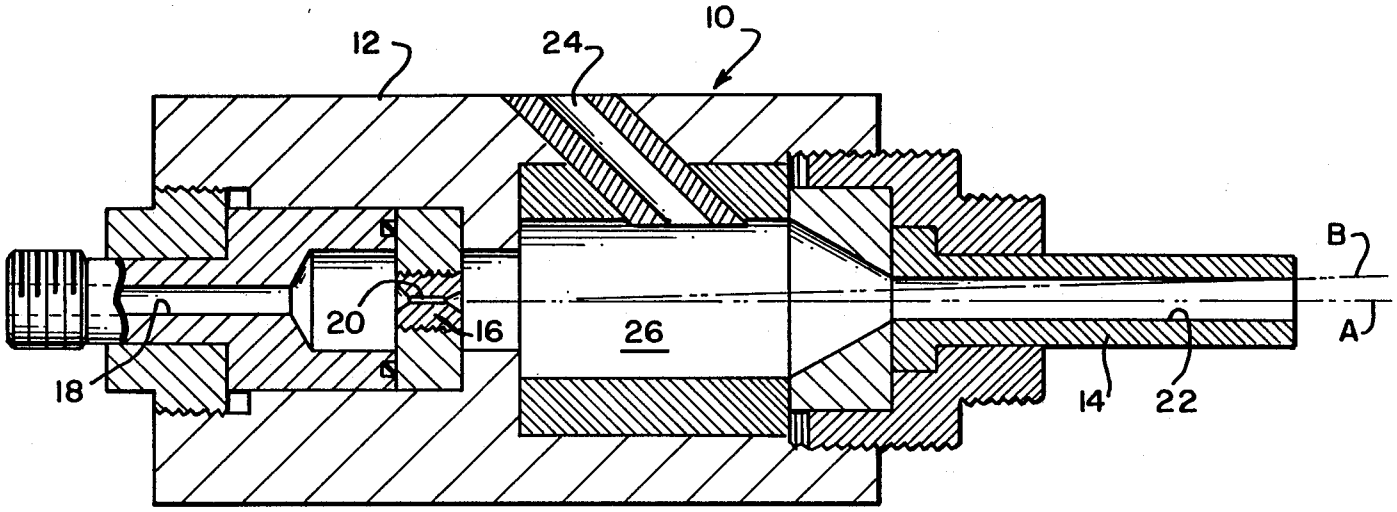
FIG. 1 PRIOR ART
Figure 3:
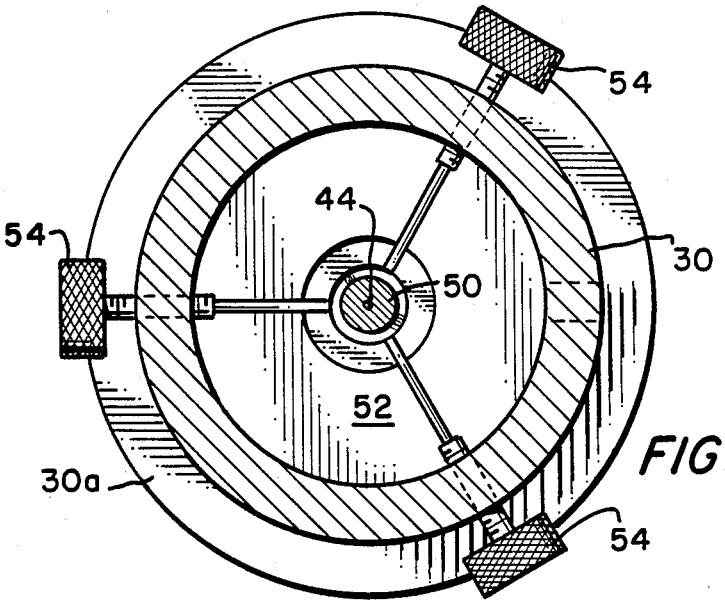
Figure 2:
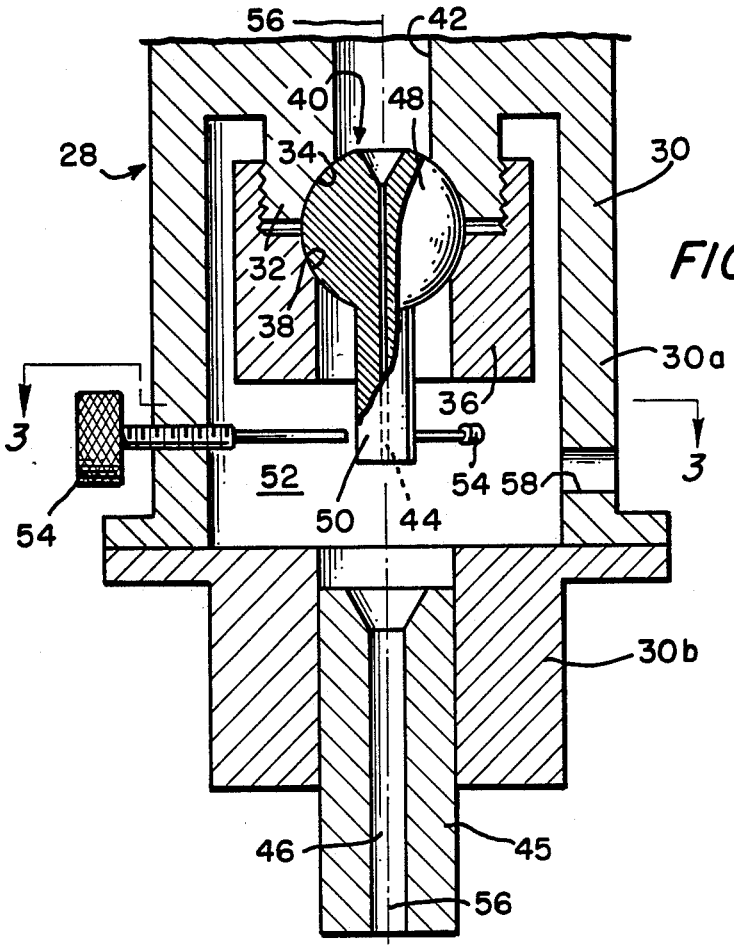

Further objects of this invention, as well as the novel features thereof, will become more apparent by reference to the following description, taken in conjunction with the accompanying figures, in which:

FIG. 1. is a longitudinal cross-section of a prior art fluid-jet-cutting nozzle assembly;

FIG. 2 is a longitudinal cross-section of an embodiment of a fluid-jet-cutting nozzle assembly according to the invention; and FIG. 3 is a cross-section taken along section 3—3 of FIG. 2.

As shown in FIG. 1, the same being an illustration of a fluid-jet-cutting nozzle assembly 10 similar to that shown in U.S. Pat. No. 4,449,332, issued on May 22, 1984, to N. J. Griffiths, for a "Dispenser for a Jet of Liquid Bearing Particulate Abrasive Material".

The assembly 10 comprises a nozzle body 12 which holds a nozzle 14 and a jet orifice element 16 fixed therein in spaced-apart disposition. The body 12, element 16, and nozzle 14 have collinearly-aligned bores 18, 20 and 22, respectively. As is known from prior art, fluid (liquid) under extreme pressure is admitted into bore 18, is formed into a very fine jet stream in element 16, and passes through the bore 22 of the nozzle 14. A side port 24 is provided to admit particulate abrasive, into a mixing chamber 26, for entrainment thereof with the jet stream.

The dash-dotted line "A" denotes the optimum, axial path for the jet stream. However, if (due to abusive use) the nozzle 14 is deflected, or if manufacturing tolerances and machining imprecisions result in misalignments of the element 16 and/or nozzle 14, the actual stream path will be as shown as line "B". This causes deformation of the nozzle bore, and if abrasive particulate is employed, especially, the nozzle 14 is soon eroded and useless.

According to my invention, of which FIGS. 2 and 3 are exemplary embodiments, the misalignments can be overcome. In FIG. 2, only the outlet end of a nozzle assembly 28 is shown. The nozzle body 30 comprises two, bolted together sections 30*a* and 30*b*. Section 30*a* has a prominent, externally-threaded land 32 with an arcuate set 34 formed thereon. A round, center-bored nut 36, with a complementary arcuate seta 38 is received by the land 32 to retain a jet orifice element 40 therebetween.

The body section 30*a* has a center bore 42, the element 40 has a center bore 44, and so has the nozzle 45 a center bore 46. Element 40 has a spherical-shaped body portion 48 and a straight shank portion 50 extending therefrom.

The body portion 48 is captured, albeit movable in universal or slewing directions, between the nut 36 and body section 30*a*. The shank portion 50 extends into a mixing chamber 52.

If the ports 44 and 46 are not in true alignment, the assembly 28 has means for making the necessary correction. Three screws 54 are in penetration of the wall of body section 30*a* and are arrayed about the shank. portion 50. By turning the proper screws 54, the shank portion 50 can be displaced, relative to the axis 56, to align the path of the stream exiting the element 40 with the bore 56 of the nozzle 45—as necessary, due to any axial misalignment of the nozzle 45.

Port 58 is the entry way for abrasive particulate into the mixing chamber 52, if such particulate is to be used.

While I have described my invention in connection with a specific embodiment thereof, it is to be clearly understood that this is done only by way of example and not as a limitation to the scope of my invention as set forth in the objects thereof and in the appended claims.

I claim:

1. A fluid-jet cutting nozzle assembly, comprising:
a body;
a nozzle; and
a jet orifice element; wherein
said nozzle and element each have a fluid-accommodating passage formed therethrough, and centrally thereof;
said body has a longitudinal axis, and comprises means for (a) receiving said nozzle and element therein, and (b) positioning said nozzle and element therein, in an established, spaced-apart disposition therebetween, along said axis, with said passages in substantially collinear alignment along said axis; and
means supported in said body for selectively adjusting said positioning of said element relative to said axis.

2.
A fluid-jet cutting nozzle assembly, comprising:
a body;
a nozzle; and
a jet orifice element; wherein
said nozzle and element each have a fluid-accommodating passage formed therethrough, and centrally thereof;

said body comprises means for (a) receiving said nozzle and element therein, and (b) positioning said nozzle and element therein, in a spaced-apart disposition, with said passages in substantially collinear alignment along a given axis; and further including means supported in said body for selectively adjusting said positioning of said element relative to said given axis; wherein said housing has a void formed therein, between said element and said nozzle, and a circumferential wall about said void;

said element has a shank portion which projects into said void; and said element-positioning means comprises means which penetrates said wall and intrudes into said void for engaging and displacing said portion.

3. A nozzle assembly, according to claim 2, wherein:

said shank portion-engaging and -displacing means comprises a plurality of adjustment screws arranged about said shank portion.

4. A nozzle assembly, according to claim 2, wherein:

said element has a spherical-shaped body portion from which said shank portion extends; and said housing has means defining a spherical-shaped socket in which said body portion of said element is confined for selective, universal movement.

5. A nozzle assembly, according to claim 3, wherein:

said screws are arranged substantially equally spaced apart about said shank portion, and project, toward said shank portion, normal to said axis.

* * * * *